United States Patent [19]

Mizuno et al.

[11] Patent Number: 4,804,498

[45] Date of Patent: Feb. 14, 1989

[54] PROCESS FOR TREATING RADIOACTIVE WASTE LIQUID

[75] Inventors: Hiroko Mizuno; Makoto Kikuchi; Shin Tamata; Tatsuo Izumida, all of Hitachi; Tsutomu Baba, Katsuta, all of Japan

[73] Assignee: Hitachi, Ltd., Tokyo, Japan

[21] Appl. No.: 938,798

[22] Filed: Dec. 8, 1986

[30] Foreign Application Priority Data

Dec. 9, 1985 [JP] Japan ..... 60-276575

[51] Int. Cl.[4] ..... G21F 9/16; G21F 9/08

[52] U.S. Cl. ..... 252/628; 210/682; 210/687; 210/712; 210/751; 252/631; 252/632; 252/635; 423/158; 423/166; 423/179; 423/183; 423/184; 423/199

[58] Field of Search ..... 252/626, 635, 628, 631, 252/632; 210/682-683, 684, 685, 687, 712, 751, 710, 723; 423/158, 166, 177, 183, 184, 199, 181, 182; 106/74, 76, 77; 159/47.3, DIG. 12

[56] References Cited

U.S. PATENT DOCUMENTS

| | | | |
|---|---|---|---|
| 4,156,646 | 5/1979 | Schulz | 252/631 |
| 4,265,861 | 5/1981 | Cleary et al. | 252/631 |
| 4,448,711 | 5/1984 | Motojima et al. | 502/74 |
| 4,476,048 | 10/1984 | Ambros et al. | 252/631 |
| 4,620,947 | 11/1986 | Carlson | 252/631 |
| 4,671,897 | 6/1987 | Mori et al. | 252/628 |

FOREIGN PATENT DOCUMENTS

| | | | |
|---|---|---|---|
| 0158780 | 10/1985 | European Pat. Off. | 252/631 |
| 0127143 | 10/1980 | Japan | 252/631 |
| 186099 | 10/1983 | Japan . | |
| 0171898 | 9/1984 | Japan | 252/631 |
| 0082895 | 5/1985 | Japan | 252/631 |

*Primary Examiner*—Howard J. Locker

*Attorney, Agent, or Firm*—Antonelli, Terry & Wands

[57] ABSTRACT

A soluble salt (sodium sulfate or sodium borate ($Na_2SO_4$ or $Na_2B_4O_7$) contained as the main component in a concentrated radioactive waste liquid generated in the BWR power plant or the PWR power plant is insolubilized and precipitated, sodium hydroxide (NaOH formed in the insolubilization is separated from the precipitate and the radioactive waste liquid slurry containing the precipitate is solidified with a hydraulic solidifying material. Since the separated caustic soda (NaOH) is free of radioactive substances, it can be easily utilized again, and since the radioactive substances are stably fixed in the solidified body, leakage of radioactivity from the solidified body can be greatly reduced.

12 Claims, 3 Drawing Sheets

PROCESS FOR TREATING RADIOACTIVE WASTE LIQUID

BACKGROUND OF THE INVENTION

1. Field of the Invention

The present invention relates to a process for treating radioactive waste liquid and, more particularly, to a treatment of concentrated radioactive waste liquid containing a soluble salt as the main component.

2. Description of the Prior Art

A solid of liquid low-level radioactive waste formed in a nuclear power plant or other facilities using radioactive rays is packed in a drum, where it is solidified with cement and is stored in this state in the nuclear power plant because delivery of the radioactive waste outside the nuclear power plant is not allowed. The volume reduction ratio of the radioactive waste is low in this cement solidification method and the number of cement-solidified drums stored in facilities increases year by year. Accordingly, from the viewpoint of economy of the storage space, various methods for increasing the volume reduction ratio of the radioactive waste have been developed.

As the main liquid radioactive waste formed in the nuclear power plant, there can be mentioned a concentrated radioactive waste liquid. At the present, this concentrated radioactive waste liquid is dried and powdered to remove water occupying the majority of the volume, and solidification is effected with a hydraulic solidifying material, especially cement. However, the following problems arise when the concentrated radioactive waste liquid is dried, powdered and then solidified with the hydraulic solidifying material.

In case of a concentrated radioactive waste liquid generated in a BWR power plant (wherein the main component is sodium sulfate ($Na_2SO_4$)), calcium hydroxide ($Ca(OH)_2$) deposited when cement is set reacts with sodium sulfate ($Na_2SO_4$) to form calcium sulfate ($CaSO_4$), which in turn reacts with tricalcium aluminate ($3CaO.Al_2O_3$) hydrate to form a swellable hydrate which deteriorates the solidified body.

In case of a concentrated radioactive waste liquid generated in a PWR power plant (wherein the main component is sodium borate ($Na_2B_4O_7$)), if the amount of the borate ion is increased relative to cement, the hydration of cement is hindered and a desirable solidified body cannot be obtained. This problem arises not only when cement is used but also when other hydraulic solidifying material is used.

As means for solving the foregoing problems, there has been examined a method in which a concentrated radioactive waste liquid is subjected to an insolubilizing treatment (wherein sodium sulfate or sodium borate ($Na_2SO_4$ or $Na_2B_4O_7$), the soluble component in the concentrated radioactive waste liquid, is converted into an insoluble substance), and then, the concentrated radioactive waste liquid is dried, powdered and solidified. Particularly, insolubilization of the concentrated radioactive waste liquid generated in the PWR power plant is disclosed in Japanese Patent Laid-Open No. 186099/1983.

However, from the results of experiments made by inventors of the present invention, it was found that powdering and solidification of the concentrated radioactive waste liquid are difficult if caustic soda (NaOH) formed in the insolubilizing treatment of the concentrated radioactive waste liquid is contained in the concentrated radioactive waste liquid to be subjected to powdering and solidification.

SUMMARY OF THE INVENTION

An object of the present invention is to provide a process for treating radioactive waste liquid wherein an insolubilized radioactive waste liquid containing a soluble salt as the main component can be stably solidified.

Another object of the present invention is to provide a process for treating radioactive waste liquid wherein the radioactive waste liquid containing a soluble salt as the main component is subjected to an insolubilizing treatment, radioactive substances such as Cs and Sr are caught in a precipitate formed by the insolubilizing treatment, re-use of caustic soda (NaOH) formed in the insolubilizing treatment is facilitated and the radioactive substances are stably fixed in a solidified body formed by solidification.

One characteristic feature of the present invention resides in that a soluble salt (sodium sulfate or sodium borate ($Na_2SO_4$ or $Na_2B_4O_7$)) contained as the main component in a concentrated radioactive waste liquid generated in the BWR power plant or the PWR power plant is insolubilized and precipitated, sodium hydroxide (NaOH) formed in the insolubilization is separated from the precipitate and the radioactive waste liquid slurry containing the precipitate is solidified with a hydraulic solidifying material.

Another characteristic feature of the present invention resides in that in order to facilitate re-use of caustic soda (NaOH) formed in the insolubilizing treatment, an adsorbent capable of adsorbing the radioactive substances such as Cs and Sr is added to the radioactive waste liquid.

Since the separated caustic soda (NaOH) is free of the radioactive substances, it can be easily utilized again, and since the radioactive substances are stably fixed in the solidified body, leakage of radioactivity from the solidified body can be greatly reduced.

In the present invention, the solidifying material comprising an alkali silicate as the main component can be used. However, other hydraulic solidifying materials, for example, cement can be used.

In the present invention, the BWR concentrated radioactive waste liquid (wherein the main component was $Na_2SO_4$) can be treated and a soluble barium salt is used and added for the insolubilizing treatment. In the case where a PWR concentrated radioactive waste liquid (wherein the main component is $Na_2B_4O_7$) is treated, a soluble calcium salt is used and added for the insolubilizing treatment. The intended effects are similarly attained also in this case.

In the present invention, the adsorbent for adsorption for the radioactive substances is added to the radioactive waste liquid simultaneously with the addition of the additive for the insolubilization. Of course, the adsorbent for adsorption of the radioactive substances may be added before or after the addition of the additive for the insolubilization.

The adsorbent for Sr is not limited to titanium chloride ($TiCl_2$), but organic and inorganic titanium compounds and organic and inorganic zirconium compounds can be used. The adsorbent for Cs is not limited to copper ferrocyanide, but other metal ferrocyanides may be used.

Furthermore, a zeolite may be used as the adsorbent instead of titanium chloride and copper ferrocyanide.

DETAILED DESCRIPTION OF THE PREFERRED EMBODIMENTS

Figure 1:
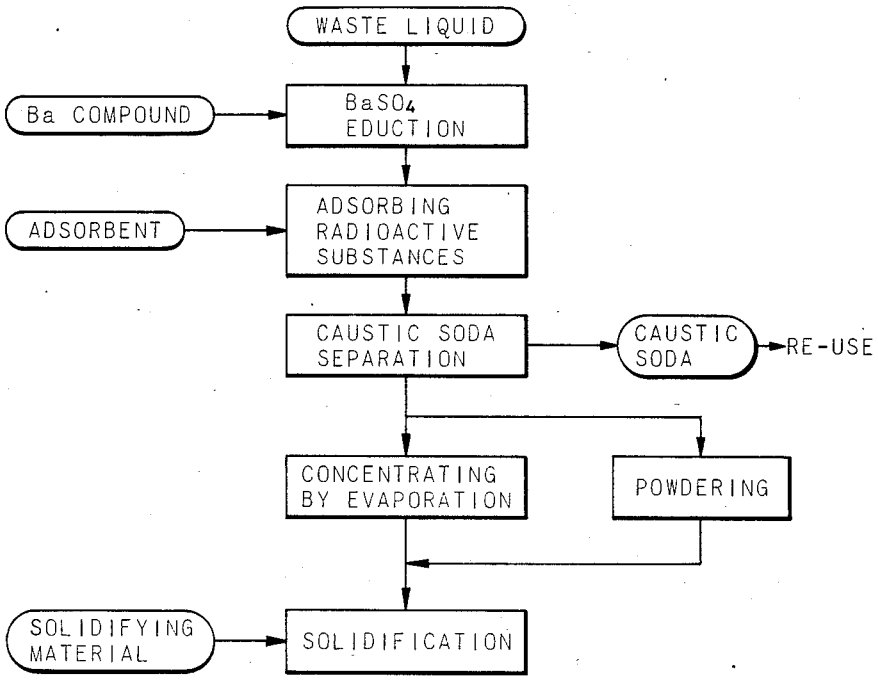
FIG. 1 is a systematic view showing a fundamental process of one embodiment of the present invention.

One embodiment of the present invention where a concentrated radioactive waste liquid generated in a BWR power plant (wherein the main component is sodium sulfate ($Na_2SO_4$)) is treated will now be described with reference to FIG. 1.

A soluble barium compound is added to the radioactive waste liquid to insolubilize sodium sulfate ($Na_2SO_4$) in the radioactive waste liquid and precipitate it as barium sulfate ($BaSO_4$). Then or simultaneously, an adsorbent is added to the radioactive waste liquid to adsorb radioactive substances such as Cs and Sr and precipitate them. By this reaction, caustic soda is formed through the following reaction course:

$$Na_2SO_4 + Ba(OH)_2 \rightarrow BaSO_4 + 2NaOH$$

After this caustic soda has been separated, the radioactive waste liquid slurry containing the precipitate of barium sulfate and the adsorbent is concentrated by evaporation or powdered, and a hydraulic solidifying material (such as cement, water glass or silica) is added after concentration or powdering or in the slurry state without concentration or powdering, whereby solidification is effected and a solidified body is obtained. The separated caustic soda is free of the radioactive substances and can be conveniently utilized again.

As the adsorbent, copper ferrocyanide is used for adsorbing and fixing Cs and titanium chloride is used for adsorbing and fixing Sr. The effects of fixing the radioactive substances by these adsorbents are shown in FIGS. 2 and 3, where amounts of Cs and Sr exuded from the final solidified body obtained by adding these adsorbents are plotted.

Figure 2:
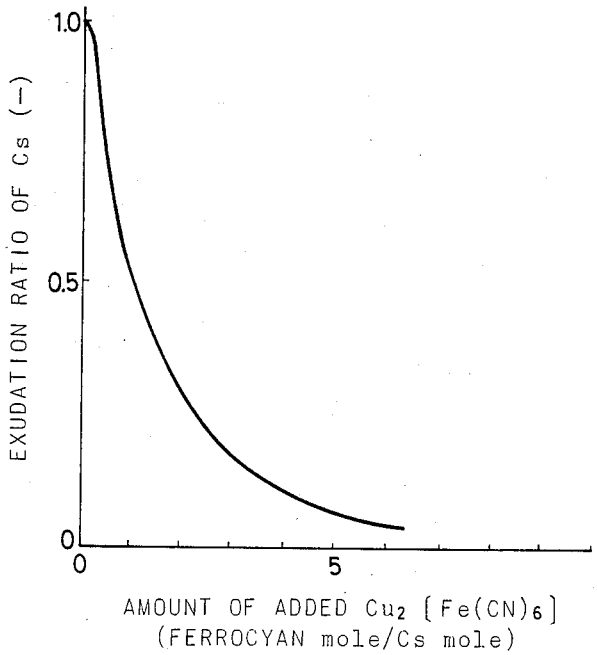
FIG. 2 is a graph showing a relationship between an amount of added copper ferrocyanide and an exudation ratio of Cs.
Figure 3:
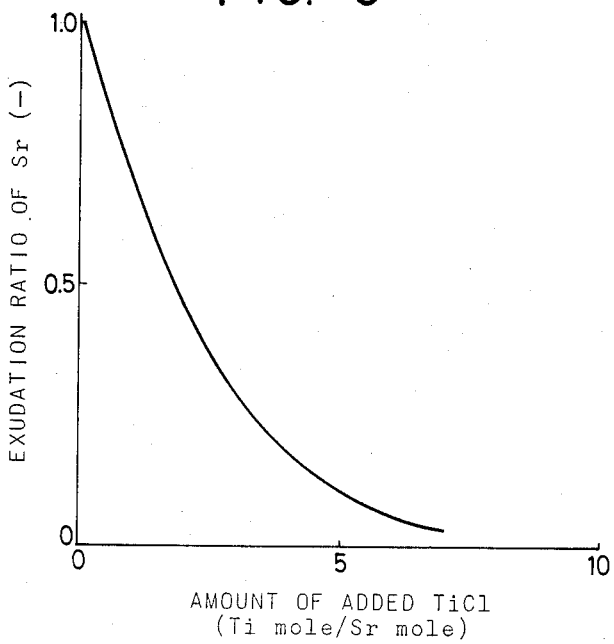
FIG. 3 is a graph showing a relationship between an amount of added titanium chloride and an exudation ratio of Cs.

As is apparent from FIGS. 2 and 3, with an increase in the amounts of added copper ferrocyanide and titanium chloride, the effect of controlling exudation of Cs and Sr is enhanced. Generally, if copper ferrocyanide or titanium chloride is added to the radioactive waste liquid in an amount of about 5 moles per mole of Cs or Sr in the waste liquid, the majority of Cs or Sr can be adsorbed and fixed.

The present invention will now be described in detail with reference to the following examples.

EXAMPLE 1

In this example, a radioactive waste liquid containing sodium sulfate ($Na_2SO_4$) as the main component was treated, with barium hydroxide ($Ba(OH)_2$) used as the soluble barium compound, copper ferrocyanide and titanium chloride ($TiCl_2$) added as the adsorbent, and a solidifying material comprising an alkali metal silicate as the main component and a phosphate as the hardening agent. This example will now be described with reference to the flow-chart of FIG. 4.

From a radioactive waste liquid tank 1, a radioactive waste liquid containing sodium sulfate ($Na_2SO_4$) at a solid concentration of 20% by weight (the amount of solid sodium sulfate left when water was removed) was supplied to a reaction tank 4 so that the amount of the solid sodium sulfate was 25 tons, and 56 tons of barium hydroxide was supplied to the reaction tank 4 from an additive tank 2. Furthermore, copper ferrocyanide and titanium chloride were supplied as the adsorbent to the reaction tank 4 from an additive tank 3 so that the amount of each additive was 5 moles per mole of Cs or Sr in the radioactive waste liquid.

The reaction tank 4 was heated to 80° C. by a heater 5 and the radioactive waste liquid was mixed and stirred for 1 hour by a stirrer, whereby the following reaction and adsorption of Cs and Sr were completed:

$$Na_2SO_4 + Ba(OH)_2 \rightarrow BaSO_4 + 2NaOH$$

Figure 4:
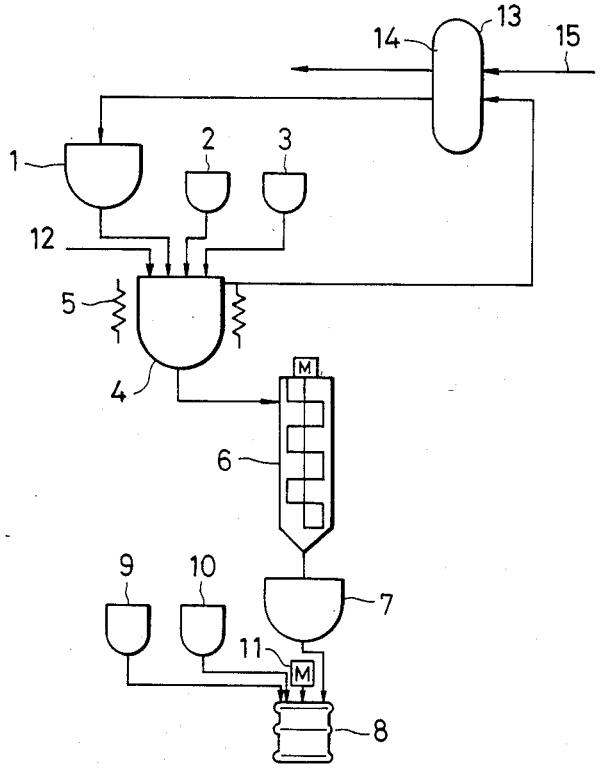
FIG. 4 is an outline flow-chart of an Example 1.

After the above-mentioned solubilizing step and the step of adsorbing and fixing Cs and Sr had been completed, separation of the adsorbent and barium sulfate by sedimentation was carried out in the reaction tank 4, whereby caustic soda (NaOH) was separated. The separated caustic soda could be utilized again for other uses. For example, as shown in FIG. 4, the separated caustic soda could be utilized for regeneration of an ion exchange resin 14 contained in a desalting device 13 used for desalting in a condensation system 15 of a reactor.

Then, the radioactive waste liquid slurry containing the precipitate of barium sulfate and the adsorbent was dried and powdered by a drier 6 and the formed powder was received in a powder hopper 7. A drum 8 was charged with 120 kg of a solidifying material comprising sodium silicate as the main component, supplied from a tank 9, and 60 kg of makeup water supplied from a tank 10, and they were kneaded to form a paste. Then, 300 kg of the above-mentioned powder was added to the drum 8 from the powder hopper 7, and the mixture was kneaded and solidified.

According to this example, since adsorption and 5ixation of the radioactive substances could be performed simultaneously with the insolubilization, separated caustic soda could be directly used for regeneration of the ion exchange resin and other purposes. Moreover, by the synergistic effect attained by insolubilization and fixation of the radioactive waste liquid, it was found that in the solidified body obtained in this example, the exudation ratio of Cs was reduced to 1/100 of the level attained in the conventional solidified body.

EXAMPLE 2

The radioactive waste liquid slurry containing the precipitate of barium sulfate and the adsorbent, prepared in Example 1, was concentrated so that water in an amount corresponding to the amount of water added together with the solidifying material in Example 1 was left in the radioactive waste liquid slurry, and then, only the powdery solidifying material was added. An effect similar to the effect attained in Example 1 was obtained. However, in this example, it was impossible to adjust the water to solidifying material ratio completely in the concentration step. In this point, the process of Example 1 is preferable.

EXAMPLE 3

In the foregoing two examples, the adsorbent for Cs and Sr was added to the radioactive waste liquid. In the present invention, the intended effects of the present invention can be similarly attained even if the adsorbent is not added to the radioactive waste liquid. In order to demonstrate this fact, the procedures of the foregoing two examples were repeated in the same manner except that the adsorbent was not added to the reaction tank 4. When caustic soda formed in the insolubilization step was separated, a solidified body having a sufficient strength was obtained.

Figure 5:
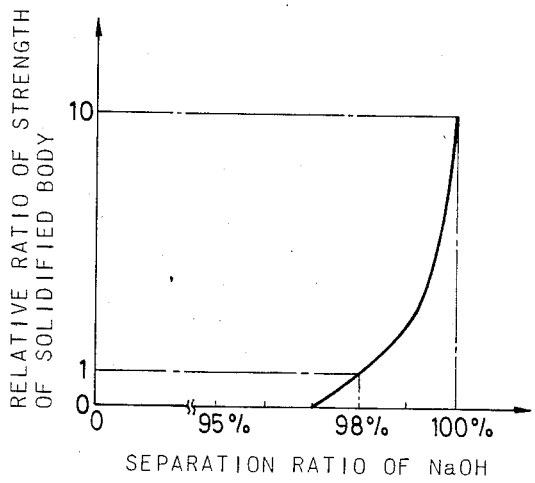
FIG. 5 is a graph showing a relationship between a ratio of separation of caustic soda and a relative ratio of strength of a solidified body.

FIG. 5 illustrates increase of the strength of the solidified body by separation of caustic soda. In FIG. 5, the ordinate represents the relative strength of the solidified body calculated based on the supposition that the strength for the solidified body obtained by powdering the radioactive waste liquid without insolubilization of sodium sulfate and solidifying the powder with sodium silicate is 1. The abscissa represents the ratio of separation of caustic soda from the radioactive waste liquid.

As is apparent from FIG. 5, if caustic soda formed in the insolubilization step is not separated and the radioactive waste liquid is directly powdered and solidified, a solidified body cannot be obtained. If the separation ratio of caustic soda exceeds a certain level, a solidified body can be obtained and the strength of the solidified body can be improved.

In this example, it was confirmed that if the separation ratio of caustic soda exceeded about 97%, a solidified body could be obtained and the strength of the solidified body was increased with increase of the separation ratio of caustic soda.

In this example, the radioactive waste liquid slurry containing the precipitate of sodium sulfate ($BaSO_4$) is powdered and solidified. Similarly to the foregoing Example 2, when the radioactive waste liquid slurry is concentrated by evaporation and solidified, the strength of the solidified body is improved.

In this example, the radioactive substances contained in caustic soda, such as Cs and Sr, where not removed. However, a radioactive substance filter member packed with copper ferrocyanide and titanium chloride may be disposed in the midway of piping from the reaction tank 4, if necessary. In this case, caustic soda separated from the radioactive waste liquid can be conveniently utilized again. Furthermore, after the filter member is used, the filter member may be supplied to the drier 6 together with the slurry for powdering and solidification.

According to the embodiments of the present invention, since the main component of the concentrated radioactive waste liquid, that is, sodium sulfate or sodium borate ($Na_2SO_4$ or $Na_2B_4O_7$), is insolubilized, the final solidified body is very good. Furthermore, since the radioactive substances are adsorbed in the adsorbent and precipitated, the radioactive substances are not substantially contained in caustic soda formed in the insolubilizing treatment.

Accordingly, this caustic soda can be separated and utilized for regeneration of an ion exchange resin or other purposes. Moreover, since the radioactive substances are fixed in the solidified body, a very stable solidified body can be obtained.

We claim:

1. A process for treating radioactive waste liquid comprising:

a first step of converting a soluble component comprising sodium sulfate or sodium borate contained in the radioactive waste liquid into an insoluble substance by adding a soluble barium compound when the soluble component comprises sodium sulfate or a soluble calcium compound when the soluble component comprises sodium borate and precipitating the insoluble substance;

a second step of adding an adsorbent for absorbing radioactive substances, said adsorbent being selected from the group consisting of a titanium compound, a zirconium compound and a metal ferrocyanide;

a third step of separating caustic soda formed in the precipitate;

a fourth step of solidifying a slurry containing the precipitate with a hydraulic solidifying material; and a fifth step of removing said separate caustic soda for reuse of said separated caustic soda.

2. A process for treating radioactive waste liquid according to claim 1, wherein said adsorbent is copper ferrocyanide.

3. A process for treating ratioactive waste liquid according to claim 1, wherein said slurry is powdered by drying, and said fourth step is performed by adding a hydraulic solidifying material.

4. A process for treating radioactive waste liquid according to claim 1, wherein said slurry is concentrated by evaporation, and said fourth step is performed by adding a hydraulic solidifying material.

5. A process for treating radioactive waste liquid according to claim 1, wherein the separated caustic soda is passed through a filter member filled with an adsorbent for absorbing of radioactive substances.

6. A process for treating radioactive waste liquid according to claim 1, wherein before the third step, the precipitate is concentrated by evaporating a moisture component of the precipitate.

7. A process for treating radioactive waste liquid comprising:

a first step of adding an additive to the radioactive waste liquid for converting a soluble component comprising sodium sulfate or sodium borate contained in the radioactive waste liquid into an insoluble substance and for precipitating the insoluble substance and adding an adsorbent for adsorbing radioactive substances, said additive being a soluble barium compound when the soluble component comprises sodium sulfate or a soluble calcium compound when the soluble compound comprises sodium borate, and said adsorbent being selected from the group consisting of a titanium compound, a zirconium compound and a metal ferrocyanide;

a second step of separating caustic soda formed in conversion of the radioactive waste liquid into the insoluble substance;

a third step of solidifying a slurry of the radioactive waste liquid separated from said caustic soda with a hydraulic solidifying material; and a fourth step of removing said separated caustic soda for reuse of said separated soda.

8. A process for treating radioactive waste liquid according to claim 7, wherein adding the adsorbent for adsorption of the radioactive substances is performed in advance of adding the additive for converting the soluble component contained in the radioactive waste liquid into the insoluble substance and for precipitating the insoluble substance.

9. A process for treating radioactive waste liquid according to claim 7, wherein the slurry is concentrated by evaporation of a moisture component of the slurry in advance of the third step of solidifying the slurry with the hydraulic solidifying material.

10. A process for treating radioactive waste liquid comprising:

a first step of converting a soluble component comprising sodium sulfate or sodium borate contained in the radioactive waste liquid into an insoluble substance by adding a soluble barium compound when the soluble component comprises sodium sulfate or a soluble calcium compound when the soluble component comprises sodium borate and precipitating the insoluble substance;

a second step of adding an adsorbent for adsorbing radioactive substances, said adsorbent being selected from the group consisting of a titanium compound, a zirconium compound and a metal ferrocyanide;

a third step of separating caustic soda formed in the precipitate;

a fourth step of powdering the precipitate by drying;

a fifth step of solidifying the dried powder by adding water and a hydraulic solidifying material; and a sixth step of removing said separated caustic soda for reuse of said separated caustic soda.

11. A process for treating radioactive waste liquid comprising:

a first step of adding an additive to the radioactive waste liquid for converting a soluble component comprising sulfate or sodium borate contained in the radioactive waste liquid into an insoluble substance and for precipitating the insoluble substance and adding an adsorbent for adsorbing radioactive substances, said additive being a soluble barium compound when the soluble component comprises sodium sulfate or a soluble calcium compound when the soluble component comprises sodium borate, and said adsorbent being selected from the group consisting of a titanium compound, a zirconium compound and a metal ferrocyanide;

a second step of separating caustic soda formed in conversion of the radioactive waste liquid into the insoluble substance;

a third step of powdering by drying a slurry of the radioactive waste liquid from which caustic soda is separated;

a fourth step of solidifying the dried powder by adding water and a hydraulic solidifying material; and a fifth step for removing said separated caustic soda for reuse of said separated caustic soda.

12. A process for treating radioactive waste liquid according to claim 1, wherein the second step of adding an adsorbent is performed simultaneously with the first step of converting and precipitating.

* * * * *